US009508523B2

(12) United States Patent
Eaton et al.

(10) Patent No.: US 9,508,523 B2
(45) Date of Patent: Nov. 29, 2016

(54) FORWARD FLUX CHANNEL X-RAY SOURCE

(71) Applicants: Mark F Eaton, Austin, TX (US); Mark Lucente, Austin, TX (US)

(72) Inventors: Mark F Eaton, Austin, TX (US); Mark Lucente, Austin, TX (US)

(73) Assignee: STELLARRAY, INC., Austin, TX (US)

( * ) Notice: Subject to any disclaimer, the term of this patent is extended or adjusted under 35 U.S.C. 154(b) by 108 days.

(21) Appl. No.: 14/214,811

(22) Filed: Mar. 15, 2014

(65) Prior Publication Data

US 2015/0262783 A1 Sep. 17, 2015

(51) Int. Cl.
*H01J 35/08* (2006.01)
*G21K 1/02* (2006.01)

(52) U.S. Cl.
CPC ..... *H01J 35/08* (2013.01); *G21K 1/02* (2013.01); *H01J 2235/086* (2013.01); *H01J 2235/18* (2013.01)

(58) Field of Classification Search
CPC ..... H01J 35/04; H01J 35/08; H01J 2235/08; H01J 2235/086
See application file for complete search history.

(56) References Cited

U.S. PATENT DOCUMENTS

| | | | | |
|---|---|---|---|---|
| 4,521,903 | A * | 6/1985 | Braun | H01J 35/12 378/141 |
| 6,385,292 | B1 * | 5/2002 | Dunham | A61B 6/032 378/122 |
| 6,785,359 | B2 * | 8/2004 | Lemaitre | H01J 35/14 378/136 |
| 6,947,522 | B2 * | 9/2005 | Wilson | H01J 35/10 378/124 |
| 6,975,703 | B2 * | 12/2005 | Wilson | H01J 35/30 378/119 |
| 7,068,749 | B2 * | 6/2006 | Kollegal | A61B 6/032 378/10 |
| 7,206,379 | B2 * | 4/2007 | Lemaitre | H01J 3/021 315/501 |
| 7,558,374 | B2 * | 7/2009 | Lemaitre | H01J 35/14 378/10 |
| 8,472,586 | B2 * | 6/2013 | Ueda | H01J 35/065 378/121 |
| 2015/0262783 | A1 * | 9/2015 | Eaton | H01J 35/14 378/62 |
| 2015/0357148 | A1 * | 12/2015 | Morton | H01J 35/12 378/143 |

* cited by examiner

*Primary Examiner* — Thomas R Artman

(57) ABSTRACT

This invention provides a source of x-ray flux in which x-rays are produced by e-beams impacting the inner walls of holes or channels formed in a metal anode such that most of the electrons reaching the channel impact an upper portion of said channel. A portion of the electrons from this primary impact will generate x-rays. Most of the electrons scatter but they continue to ricochet down the channel, most of them generating x-rays, until the beam is spent. A single channel source of high power efficiency and high power level x-rays may be made in this way, or the source can be of an array of such channels, to produce parallel collimated flux beams of x-rays.

10 Claims, 14 Drawing Sheets

FORWARD FLUX CHANNEL X-RAY SOURCE

PRIORITY DATA

Continuation in part of application Ser. No. 12/692,472, filed on Jan. 22, 2010, which is a continuation in part of application Ser. No. 12/201,741, filed on Aug. 29, 2008, issued as U.S. Pat. No. 8,155,273, which is a continuation in part of application Ser. No. 11/355,692, filed on Feb. 16, 2006, now abandoned, all of which are incorporated herein in their entirety.

Provisional application No. 61/801,215, filed on Mar. 15, 2013.

TECHNICAL FIELD OF THE INVENTION

This invention relates in general to the field of radiation sources in which x-rays are produced by accelerated impact on metal anodes and more particularly to an x-ray source having superior conversion efficiency of electrons into x-rays and increased x-ray flux output, as well as to parallel beam x-ray sources formed of arrays of such individual x-ray sources.

BACKGROUND OF THE INVENTION

This invention provides a source of x-ray flux in which x-rays are produced by e-beams impacting the inner walls of holes or channels formed in a metal anode such that most of the electrons reaching the channel impact an upper portion of said channel. A small portion of the electrons will produce x-rays from this primary impact but most of them will be scattered, mostly in the forward direction of the e-beam trajectory, with the scattered electrons again impacting the walls of the channel and either generating x-rays or scattering, the scattered electrons then repeating the process until most of the electron beam has generated x-rays. A small portion of the beam will not generate x-rays at the channel walls through either primary or secondary (scattered) impact. This portion can impact a thin film of metal disposed across the diameter of the end of the channel, where it will either generate more x-rays or be drained away. The x-rays generated at the channel walls, and those few generated at the exit of the channel exit the channel out an anode window provided at the end of the channel. This anode window may support the thin metal film at the end of the channel.

Since the anode surface which generates x-rays in this source is many times greater than the corresponding surface of either the reflective or a transmission anodes of prior art x-ray sources, which are power limited by the generation of heat from e-beam impact, the disclosed source can also accommodate much higher electron beam current and therefore generate much higher x-ray flux from a given x-ray spot size. The disclosed source has the further advantage of pre-collimation of the exiting x-ray flux by the shape of the channel walls. It has a yet further advantage of hardening the beam, since some of the lower energy x-rays generated at the walls will be absorbed by the walls and higher energy x-rays will exit the channel.

A single channel x-ray source with high conversion efficiency and high power can be made with the disclosed forward flux channel (FFC) x-ray source architecture. This single channel source can be advantageously used in many applications, especially those now served by microfocus x-ray tubes, which commonly use a transmission x-ray target. In another embodiment, an FFC array source can be made with multiple channels in a broad anode plate, each channel receiving an e-beam from a cathode in a cathode array provided opposite the anode plate across the vacuum space of the source. FFC array sources, in linear or X-Y arrays, may be made as flat panels, as curved arrays or in other formats. They may be advantageously used in many other applications, including stationary computed tomography (CT) systems, parallel x-ray beam imaging systems and as wide sources of parallel x-ray pencil beams in phase contrast imaging (PCI) systems, coded aperture imaging systems or dynamically addressed coded source systems. In a further embodiment, the channels may be formed as long slits in the anode, to provide a fan beam of high power x-ray flux.

There is a continuing need for x-ray sources with higher flux levels and power efficiency. Particularly in x-ray imaging systems, an increase in flux power translates directly to a decrease in image acquisition time, to the limit of the detector. In x-ray analytical systems, the speed and scope of the systems is often limited by the flux available from the x-ray source used.

Prior art x-ray tubes with an angled reflective anode target are limited in their power output and efficiency by the fact that when the e-beam hits the anode surface only a small part of it penetrates the target material to generate x-rays; nearly half of the e-beam is scattered off the target back towards the cathode and loses power to make x-rays. Transmission anode x-ray sources have a fundamental limitation in generating x-ray flux in that the target must be a thin metal film to allow transmission of x-rays generated by the voltages used in imaging systems, but this thin film is inherently limited in the amount of heat it can dissipate and the heat it can handle before it melts or peals off the glass, beryllium or other flux exit window on which it is formed. Transmission targets also emit flux in all directions out the source. If collimators are used after the source, they will further diminish the already faint level of x-ray flux.

There are also a number of emerging x-ray imaging modalities which need new x-ray sources. Stationary CT systems, in which x-ray spots are addressed electronically in x-ray sources with multiple x-ray pixel (xel) locations, are being developed as an alternative to conventional CT systems using a classical x-ray tube rotating around a mechanical gantry. Various sources for these systems have been described in the prior art. Medical imaging typically requires e-beam current densities on the anode spot of at least a few A/cm2 at tens of kV electron energies, which is more power than a thin film transmission sources can handle before melting or delaminating. Angled xel array sources, such as those taught by U.S. Pat. No. 6,850,595 and U.S. Pat. No. 7,082,182, can handle higher power loads, but still may suffer anode pitting. Use of an angled target limits these sources to linear 1D xel arrays. Flat reflective anode sources, such as that taught in U.S. Pat. No. 8,155,273 and US 2010/0189223, can provide x-y xel matrixes, but they too would benefit from having a larger surface area over which to distribute the e-beam power.

Imaging systems in which multiple parallel x-ray flux beams pass through an imaging subject to be detected by a corresponding array of x-ray detectors, or an array of areas on a single x-ray detector, would have a number of advantages. More flux power could be generated by the use of multiple anode emission spots, since it is the instantaneous heat load on the anode which is most responsible for pitting or anode overheating. The use of multiple, limited-angle x-ray flux beamlets would also substantially reduce the amount of x-ray scatter in the subject, allowing a reduction in the radiation dose delivered to the subject. The increase in dose now commonly used to account for scatter in the subject, known as the bucky factor, could be cut reduced. With an x-ray source generating 77×77 or so of these x-ray beamlets, for examples, the bucky factor could be reduced by more than half in some imaging applications, such as breast imaging. Prior art sources, however, are not adapted to deliver multiple parallel x-ray beamlets. A flat panel source of the present invention, however, would be well adapted to such use and enable the development of new types of low dose imaging systems.

PCI is an emerging imaging modality which promises major improvements in dose reduction, improved sensitivity in low contrast applications such as breast imaging and high resolution. Prior art x-ray sources, however, are inadequate to make PCI useful for clinical and other large object imaging. Current PCI imaging systems rely on single pencil beams of x-ray flux, which do not cover a clinically meaningful area, or synchrotron radiation sources, which are large, expensive and not available in clinical settings. There has been research into the use of gratings to collimate and spread the flux from x-ray tubes over a wider area, but passing flux from a point source through a grating results in most of the flux from a point source being absorbed in the grating, resulting in unacceptably long image acquisition times. The source of the present invention can provide a highly parallel array of narrow or pencil beams, which can cover a wide area, and can be used with gratings and other PCI system techniques to make PCI available in clinical settings.

Coded source imaging is another new modality which promises high resolution, low noise and therefore low dose. It is possible to place a fixed coded aperture grating in front of an x-ray source and get a coded source but this too will have low flux power and long imaging times. The source of the present invention can be made with fine pitch xels to provide a coded source with high flux power. This source can also be dynamically addressed, for dynamic coded source imaging. This further enables coded source CT by shifting the coded source across a panel or array of panels.

There have been prior attempts to make a forward flux channel x-ray source. U.S. Pat. No. 4,675,890 teaches a rectilinear bore hole source with straight hole walls. Electrons at the high kV energies used in x-ray generation, however, are traveling at relativistic speeds and do not change course easily. Nearly all the electrons would pass straight through a straight channel and not generate x-rays. This prior art source teaches the use of magnets near the anode to deflect the beam into the channel walls, but this would be very hard to do by the time the electrons approach the anode and would require impractically large magnets. U.S. Pat. No. 6,993,115 also discloses forward flux channels in an x-ray anode, but this too has straight walls and relies on space charge spreading to direct some of the electrons into the channel walls. In reality, e-beams that are confined enough to make it from the cathode to the anode and into the channel will not suddenly start spreading due to space charge. Another source architecture, disclosed in U.S. Pat. No. 7,349,525, uses a flat anode disposed at a shallow angle on one side of a channel to receive the incoming electron beam. X-ray flux is then generated at a shallow angle and some of it passes through a collimating channel. While an improvement over prior sources, this source, by having the anode on only one side of the channel does not make use of the scattered portion of the electron beam and will therefore still have limited efficiency and power. It is also a large mechanical assembly, intended for use in a curved linear array of xels for a large stationary CT system and is not adapted for 2D parallel beam imaging, PCI or other of the imaging systems enables by the source of the present invention.

A need therefore exists for forward flux channel x-ray sources with improved power efficiency and power levels, adapted for use as single channel sources and for use in 2D arrays and dense arrays.

OBJECTS AND ADVANTAGES OF THE INVENTION

It is an object of the invention to provide an x-ray source with superior conversion efficiency of electrons into x-rays and increased x-ray flux output, thereby decreasing image acquisition times i x-ray imaging systems and improving the speed and scope of x-ray analytical systems. It is a further object of the invention to provide a highly collimated source of x-ray flux. Another object of the invention is to enable improved x-ray imaging systems, including CT systems. A yet further object is to enable new imaging modalities such as parallel beam imaging, PCI and coded source imaging. An important advantage of the invention is the use of a larger x-ray generation area on the anode for a given x-ray spot size, which allows higher electrical power to be delivered to the anode than is possible with prior art sources. Another important advantage is the use of more of the electron beam to generate x-rays and reduce the inefficiency of prior art sources. A further advantage is the adaptability of the invention in source ranging from single channel sources to highly parallel array sources of x-rays. The ability to make large arrays of x-ray flux beams in linear, 2D and curved formats enables new imaging modalities not possible with prior art sources. The x-ray source of this system can be scaled to very large arrays of hundreds or thousands of x-ray flux beams.

SUMMARY OF THE INVENTION

This invention provides a source of x-ray flux in which x-rays are produced by e-beams impacting the inner walls of holes or channels formed in a metal anode such that most of the electrons reaching the channel impact an upper portion of said channel. A portion of the electrons from this primary impact will generate x-rays. Most of the electrons scatter but they continue to ricochet down the channel, most of them generating x-rays, until the beam is spent. A single channel source of high power efficiency and high power level x-rays may be made in this way, or the source can be of an array of such channels, to produce parallel collimated flux beams of x-rays.

BRIEF DESCRIPTIONS OF THE DRAWINGS

The attached drawings are provided to help describe the structure, operation, and some embodiments of the source of the present invention. Numerous other designs, methods of operation and applications are within the meaning and scope of the invention.

FIG. 1 shows one embodiment of an FFC x-ray source in which the channel is slanted relative to the axis of the incoming electron beam so as the ensure the e-ebeam impacts the channel wall. The accompanying graphic shows the results of modeling run using the PENELOPE particle code to show where they have their primary impact on the channel, where they generate x-rays and where they scatter to generate more x-rays.

Figure 4:
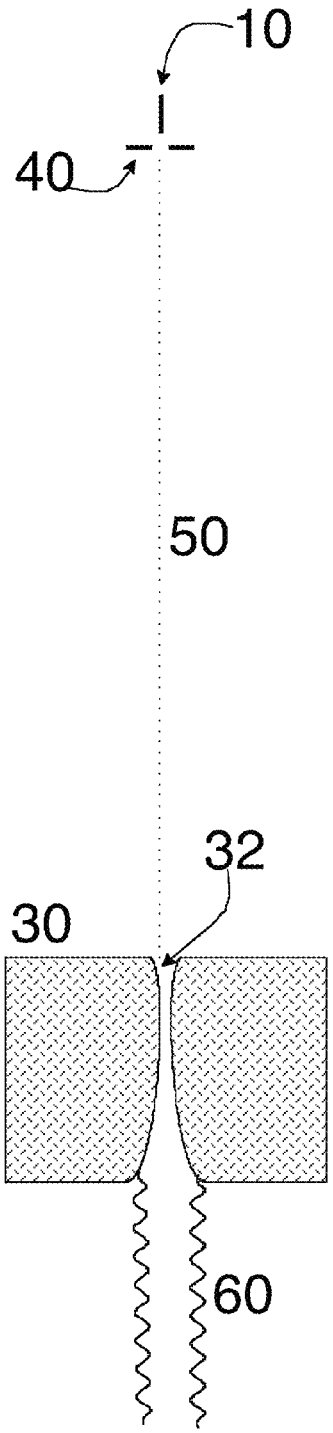
Figure 4:
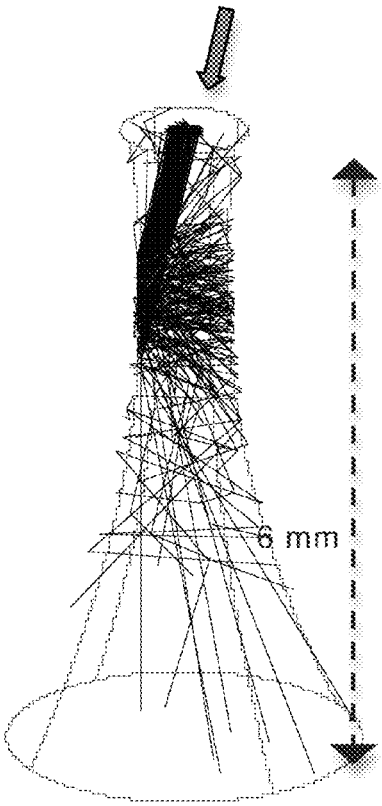

FIG. 4 shows another embodiment of an FFC x-ray source in which the channel has an hourglass shape in which it is first wider, then narrows, and then widens to an even greater extent. The accompanying graphic shows the results of modeling run using the PENELOPE particle code to show where they have their primary impact on the channel, where they generate x-rays and where they scatter to generate more x-rays.

Figure 5:
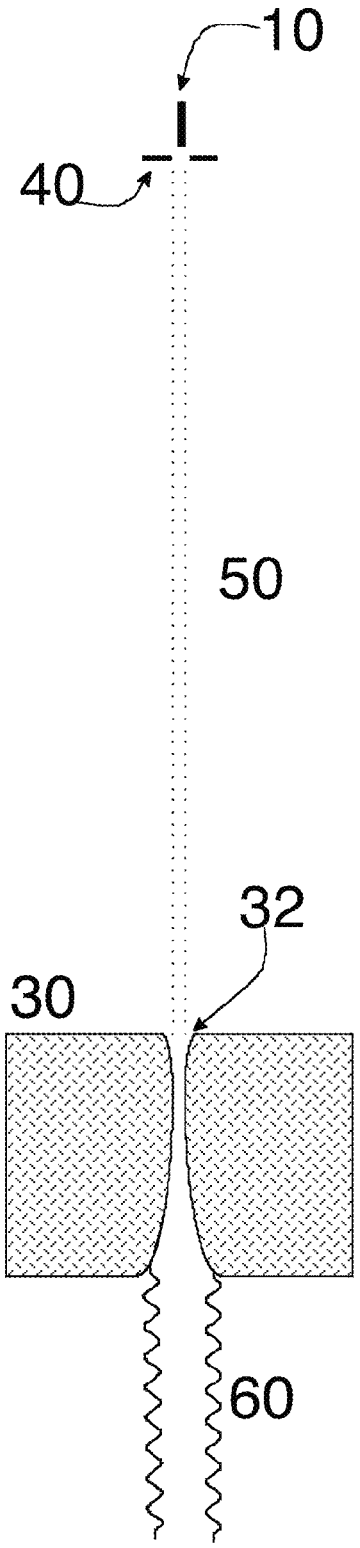

FIG. 5 shows another embodiment of an FFC x-ray source in which the channel has an hourglass shape and an annular electron beam is directed at the walls at wider opening of the channel.

Figure 6:
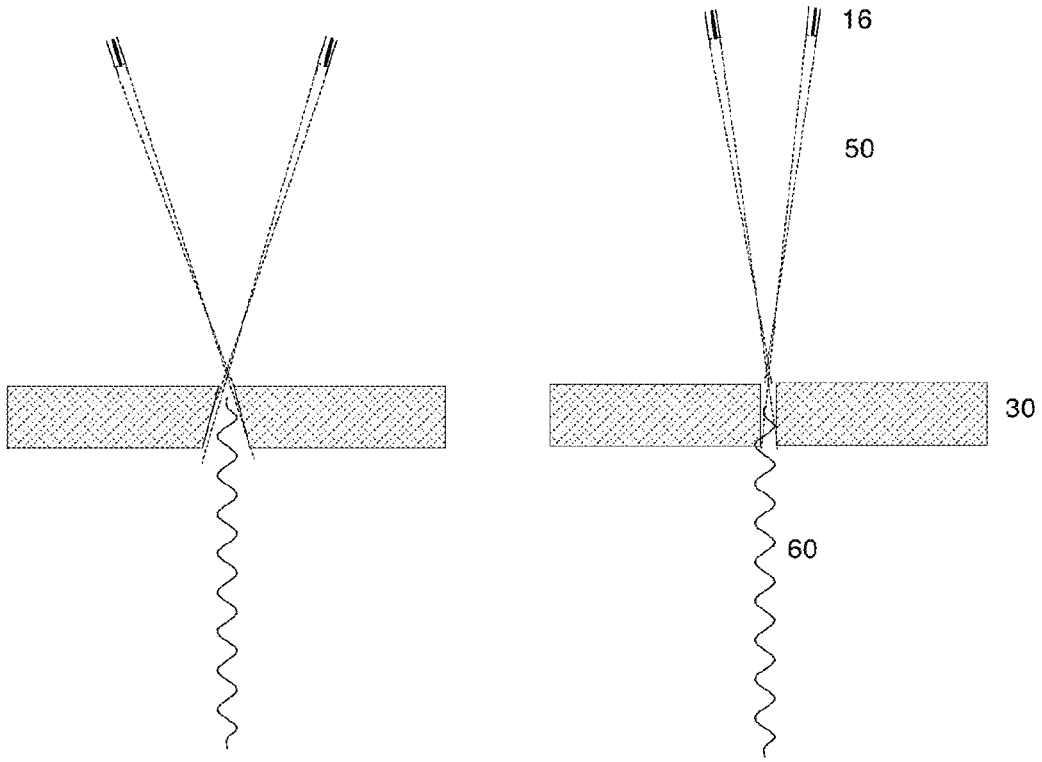

FIG. 6 shows other embodiments of an FFC x-ray source in highly focused e-e-beams are emitted into the channel from cathodes offset at an angle to the channel.

Figure 7:
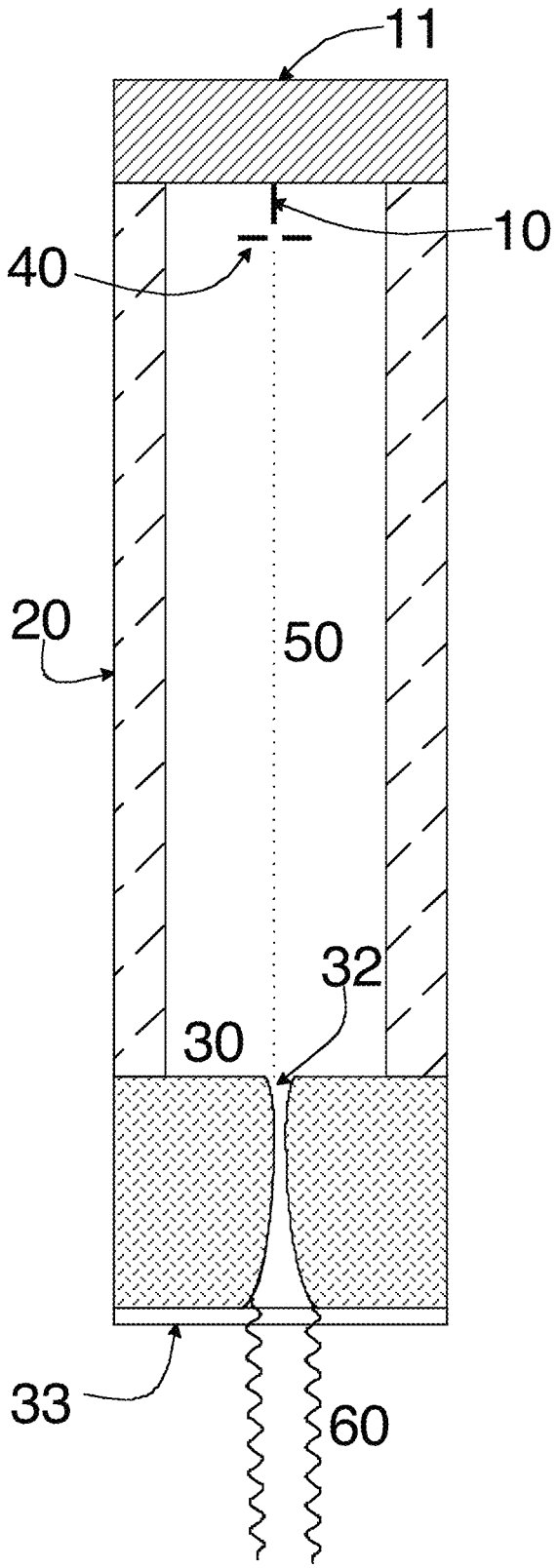

FIG. 7 shows a sealed single channel FFC x-ray source.

Figure 8:
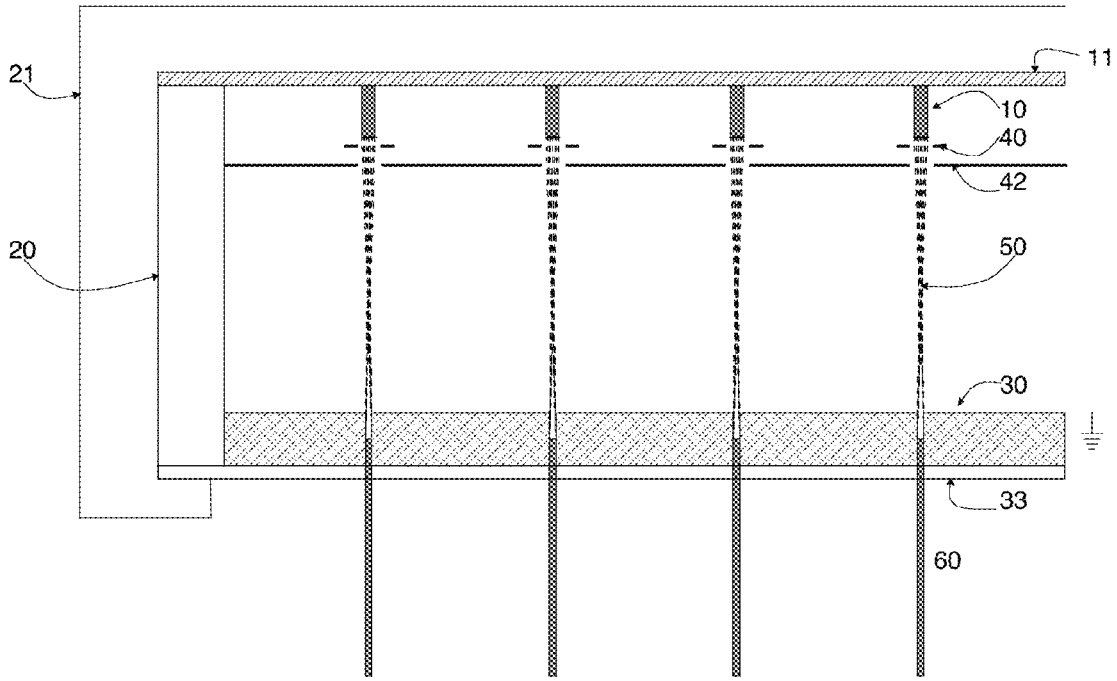

FIG. 8 shows a half section of a sealed FFC array source.

Figure 9:
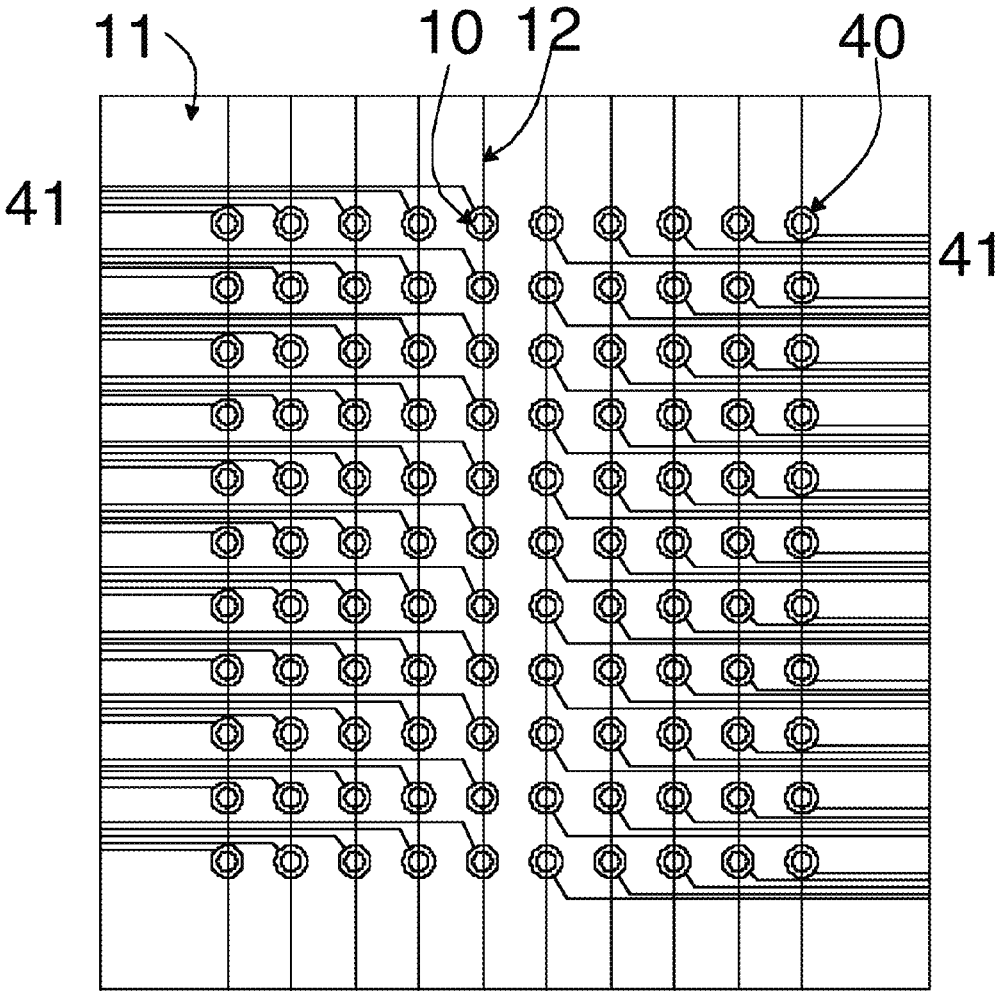

FIG. 9 shows an emitter (cathode and gate) section which can be used in an FFC array source.

Figure 10:
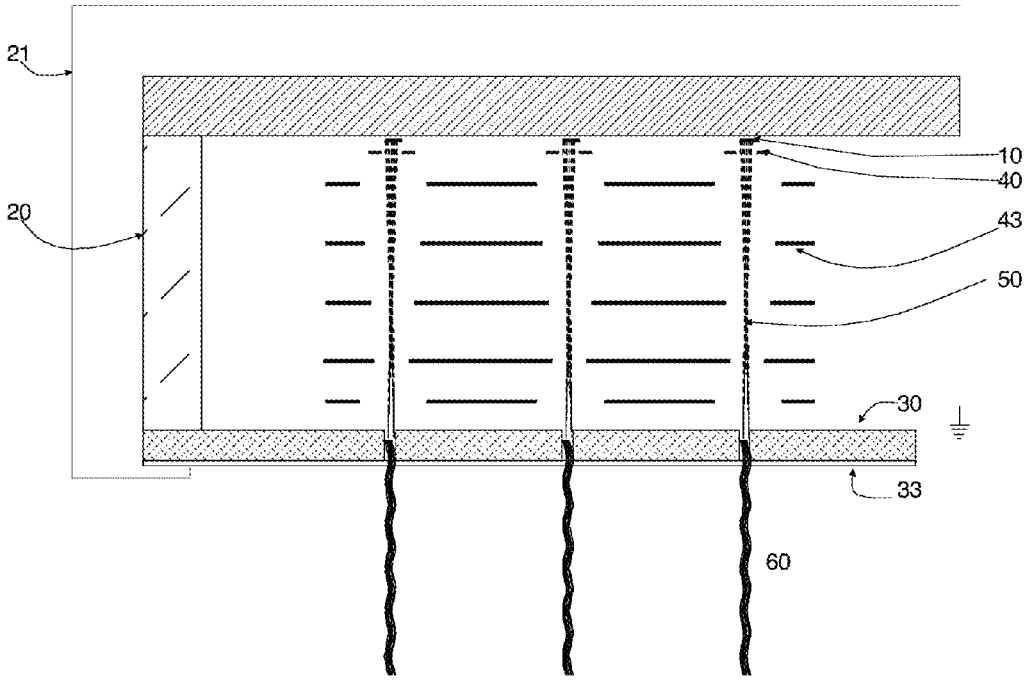

FIG. 10 shows a half section of a sealed FFC array source with an internal accelerating grid to shape an annular beam.

Figure 11:
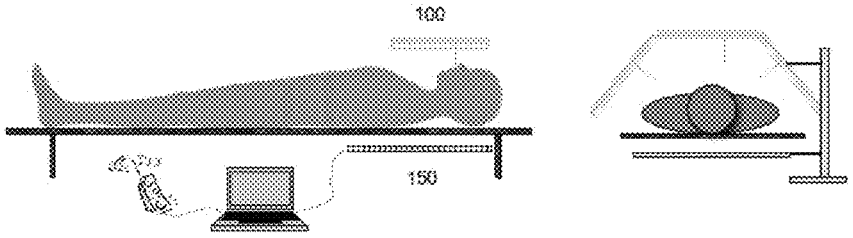

FIG. 11 shows a portable CT system using an FFC array source.

Figure 12:
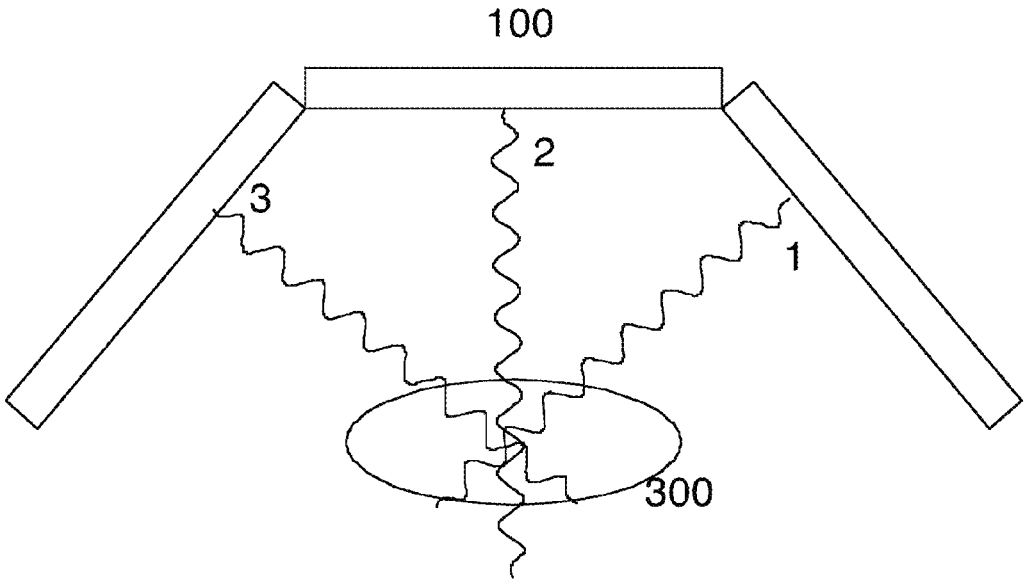

FIG. 12 shows a sequential addressing mode of operation in one direction in FFC array source imaging.

Figure 13:
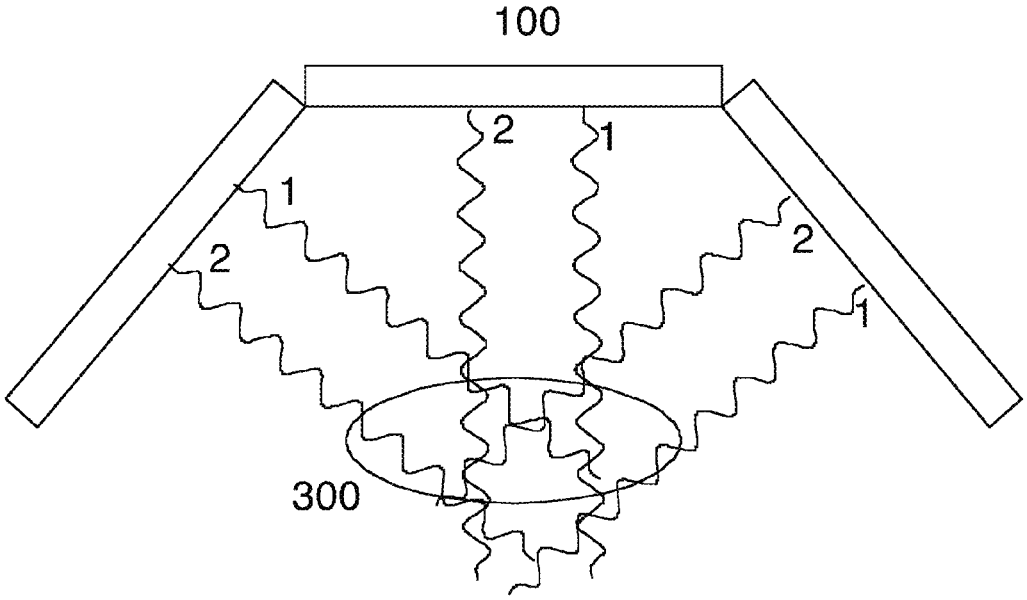

FIG. 13 shows a multiple sequential addressing mode of operation in one direction in FFC array source imaging.

Figure 14:
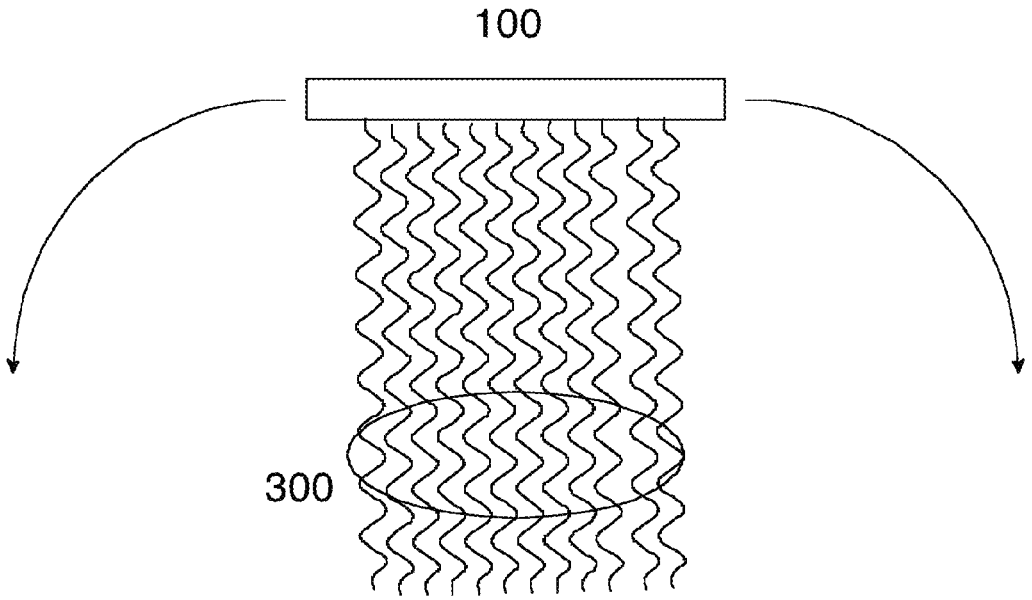

FIG. 14 shows a parallel beam mode of operation in FFC array source imaging.

Figure 15:
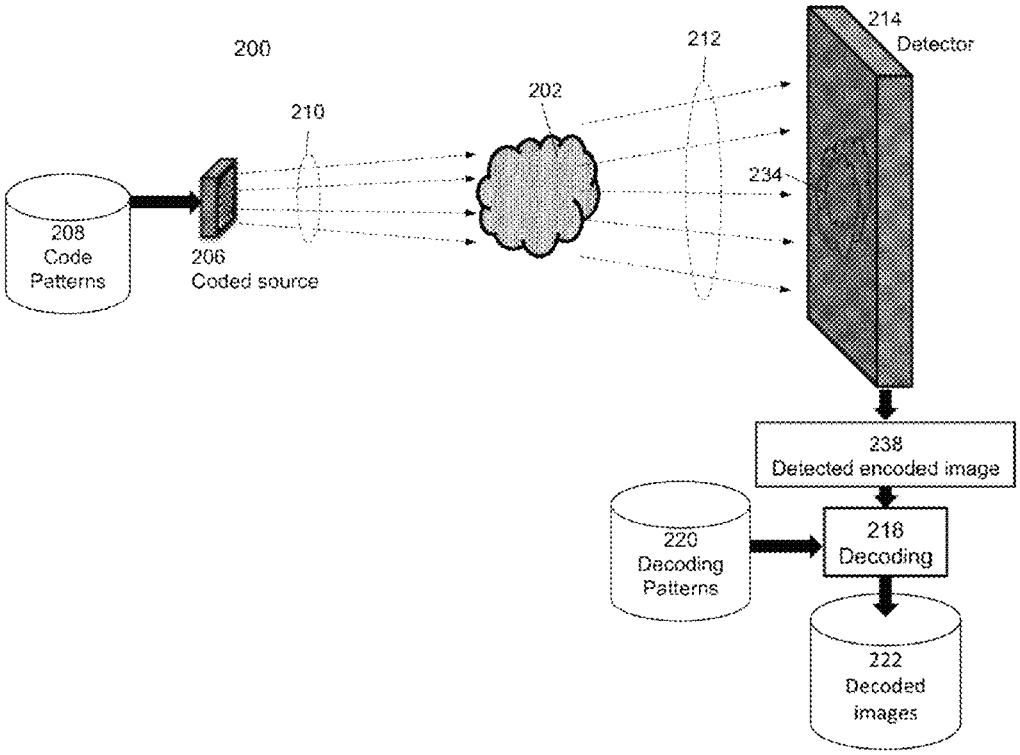

FIG. 15 shows a phase contrast imaging system using an FFC array source

Figure 16:
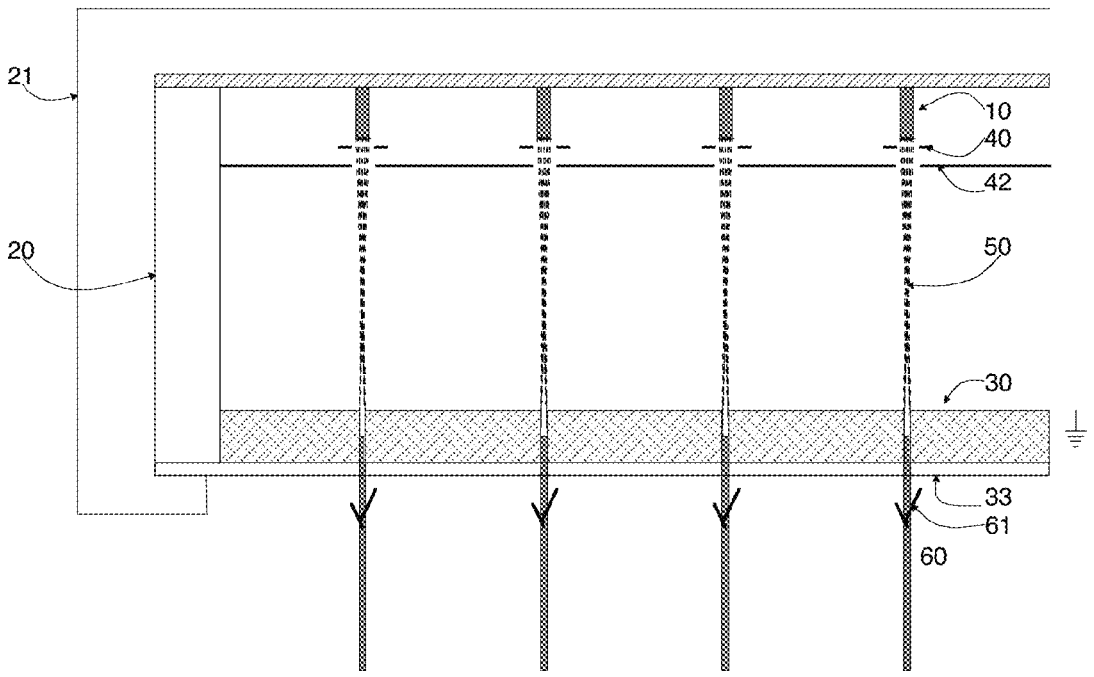

FIG. 16 shows an FFC array source with monochromators disposed adjacent the anode window.

DETAILED DESCRIPTION OF THE INVENTION

Although the following detailed description delineates specific attributes of the invention and describes specific designs and fabrication procedures, those skilled in the arts of radiographic imaging or radiation source production will realize that many variations and alterations in the fabrication details and the basic structures are possible without departing from the generality of the processes and structures.

The FFC x-ray source comprises at least a cathode and a metal anode with at least one hole (termed a channel) through the anode such that x-rays may be produced by e-beams accelerated by an electrical potential between cathode and anode to impact the upper portion of the inner wall of the channel, which may also be called the upper acceptance region. The channel will typically be annular, but other channel shapes may also be used. A small portion of the electrons (estimated at under 25%) will produce x-rays from this primary impact but most of the electrons will be scattered, mostly in the forward direction of the e-beam trajectory, with the scattered electrons again impacting the walls of the channel and either generating x-rays or scattering again, the scattered electrons then repeating the process until most of the electron beam has generated x-rays. The electrons lose slight amounts of their energy after each ricochet off the walls, but not enough to effect the amount and quality of the x-ray flux. A portion of the x-rays generated at the inner channel walls will transmit through the channel. The x-ray flux beam profile is determined by the shape of the metal channel, which serves as a collimator. If the channel has straighter walls the x-ray flux beam will have a narrow angle, and can be a straight pencil beam. If the channel flares outward towards its end, the x-ray flux beam angel will increase. FFC sources can be designed and made to produce x-ray flux beam shapes intended for various purposes.

The FFC source can be open or sealed and single channel or multi-channel. Open sources, such as are used in some microfocus x-ray imaging and analytical instruments, are actively pumped, so the x-ray source does not need its own permanently sealed vacuum package, and the vacuum chamber of the open source may include other parts of an imaging system or instrument. Sealed sources are made to be vacuum tight and are evacuated once all the elements of the source are installed and the package is sealed, typically through a pump-down tube, although in vacuo sealing methods may also be used. Flash or non-evaporable getters may be used to maintain the vacuum in sealed sources.

The source can be operated at any of the voltages used in current medical and industrial imaging settings, as well as in scientific instruments and in irradiation applications, i.e. from under 1 kV to 250 kV. Even higher voltages may be used in FFC sources intended for radiation therapy and similar applications, provided that sufficient distance is made between the cathode and anode to avoid high voltage breakdown and the electron beam is confined, for example through electrostatic means or magnetic means.

The current levels in single or multi-channel FFC sources will also depend on the application, but in general much higher current levels can be used compared to prior art sources, due to the ability of a larger anode impact area to dissipate instantaneous heat, which can decrease image acquisition times and provide other advantages in x-ray instruments. In prior art reflective or transmissive x-ray sources the spot size is given by the diameter of the anode target impacted by the e-beam and the available electron impact area is $\pi r^2$ (or $\pi r^2$ times about 4 in the case of an angled reflective target). In the disclosed source, the spot size is given by the diameter of the channel, but the available electron impact area is provided by the surface of the inner wall of the channel, or hnd, where h is the height of the channel (thickness of the anode) and d is the diameter of the spot. With a 100 μm spot and 2 mm thick plate, for example, this works out to 80 times the surface area. In practice, only a part of the channel height, mostly to about the first 500 μm, will generate x-rays, which is still a 20× increase in surface area and a profound increase in the power capacity of the anode spot. For a 20 μm spot this increase is 100×. These increases translate directly to higher feasible current levels. With the 20 μm spot size, for example, even with a 4× geometrical leverage, an FFC source will be able to handle 25 times the power of a stationary x-ray tube with an angled anode target, a profound advantage in many applications.

A small portion of the e-beam entering the FFC source will not generate x-rays at the channel walls through either primary or secondary (scattered) impact. This portion can impact a thin film of metal disposed across the diameter of the end of the channel, where it will either generate more x-rays or be drained away. The x-rays generated at the channel walls, and those few generated at the exit of the channel exit the channel to the other side of the cathode. In a sealed source, the anode window provided at the end of the channel may support the thin metal. In an open source a simple drain electrode located near the channel end may also be used.

In some FFC configurations, particularly those with a small anode thickness/channel height, a further electrode may be provided near the flux exit end of the channel. This electrode may be used to attract electrons into the channel and help direct current into the channel walls.

Virtually all the x-rays generated by the FFC source are from Bremsstrahlung or characteristic line radiation. The power efficiency of the FFC source is determined by several parameters, including the anode material and accelerating voltage, the size (height and diameter) and shape of the channel, particularly any flare out of the channel at the end, and the number of times the electron beam impacts the channel wall, which may be five to ten in channels several mm in height. Compared to prior art sources, FFC sources will lose some efficiency because the collimation of the channel constrains the x-ray flux getting through. When this is made normal through comparison with similarly collimated other sources, the FFC shows gains in efficiency due to the use of more of the e-beam and the hardening of the x-ray flux as lower energy x-rays are more likely to be absorbed by the channel walls. The inventors have analyzed these efficiency gains using models generated with the Monte Carlo PENELOPE particle code developed at Oak Ridge National Labs. The models include all aspects of electron trajectories, scattering and x-ray generation inside the channels, and x-ray flux generation through the channels. Graphical output from these models is included in FIG. 2-4. In general, power efficiency is over two times large than that of comparable collimated reflective or transmission anode sources. This means that for a given application the baseline current setting for the x-ray dose can be cut in half. In the previous example of a 20μ spot size, if the current is instead increased since the anode can handle more power, the image acquisition speed advantage increases to 50.

Various channel shapes and electron beam acceptance angles can be used in FFC sources. FIGS. 1-6 show some exemplary configurations, in these cases all assumed to be annular. The objective in channel design is to maximize the portion of the incoming electron beam which impacts the upper acceptance region of the channel and the portion of the e-beam which is converted to x-rays by this and secondary (scattered) impacts. Most of the channel designs are flared out at the bottom of the channel so as to increase the number of secondary electron impacts as the e-beam ricochets down the channel.

Figure 1:
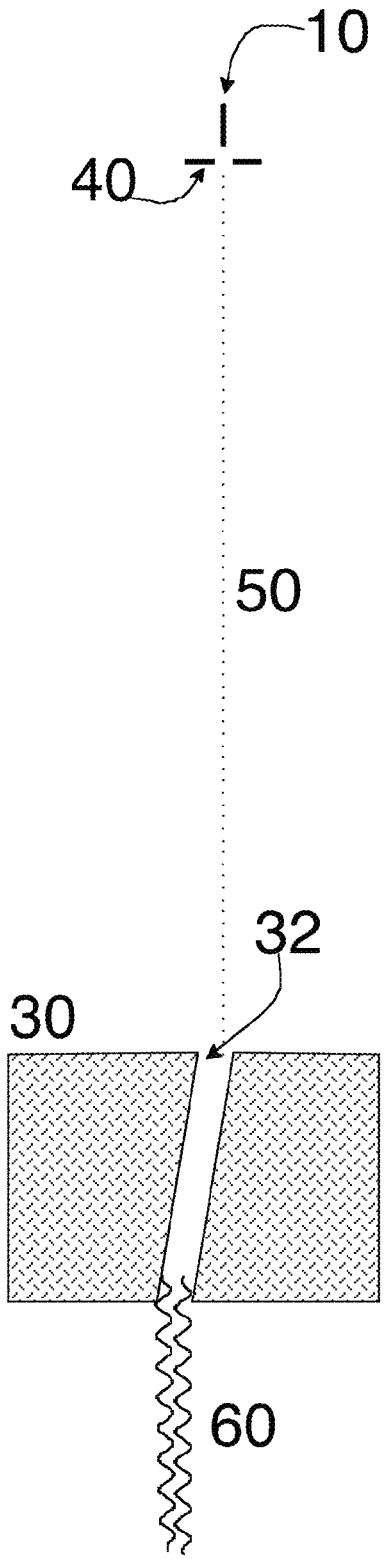

FIG. 1 shows a simple angled channel, which is shown with a straight channel wall but may also be flared out towards the bottom of the channel. This channel design uses the same idea as an angled microchannel plate photodetector. E-beams 50 from cathode 10, in this case extracted by gate 40, accelerate toward metal anode 30 to enter channel 32 and begin x-ray generation, x-ray flux 60 exiting the end of channel 32. Since the channel is angled relative to the top surface of anode 30, an e-beam which is properly aligned to anode channel 32 and normal (or near normal) to the top surface of anode 30, which it will be given the high acceleration of the electrons, must impact the upper portion of the channel. The anode material is any of the metals which can be used in x-ray generation, for example, W, Mo or Cu. This type of anode may be made by drilling or otherwise forming the channels into a piece of anode metal and then slicing or trimming the top and bottom surfaces of the anode at the desired angle.

Figure 2:
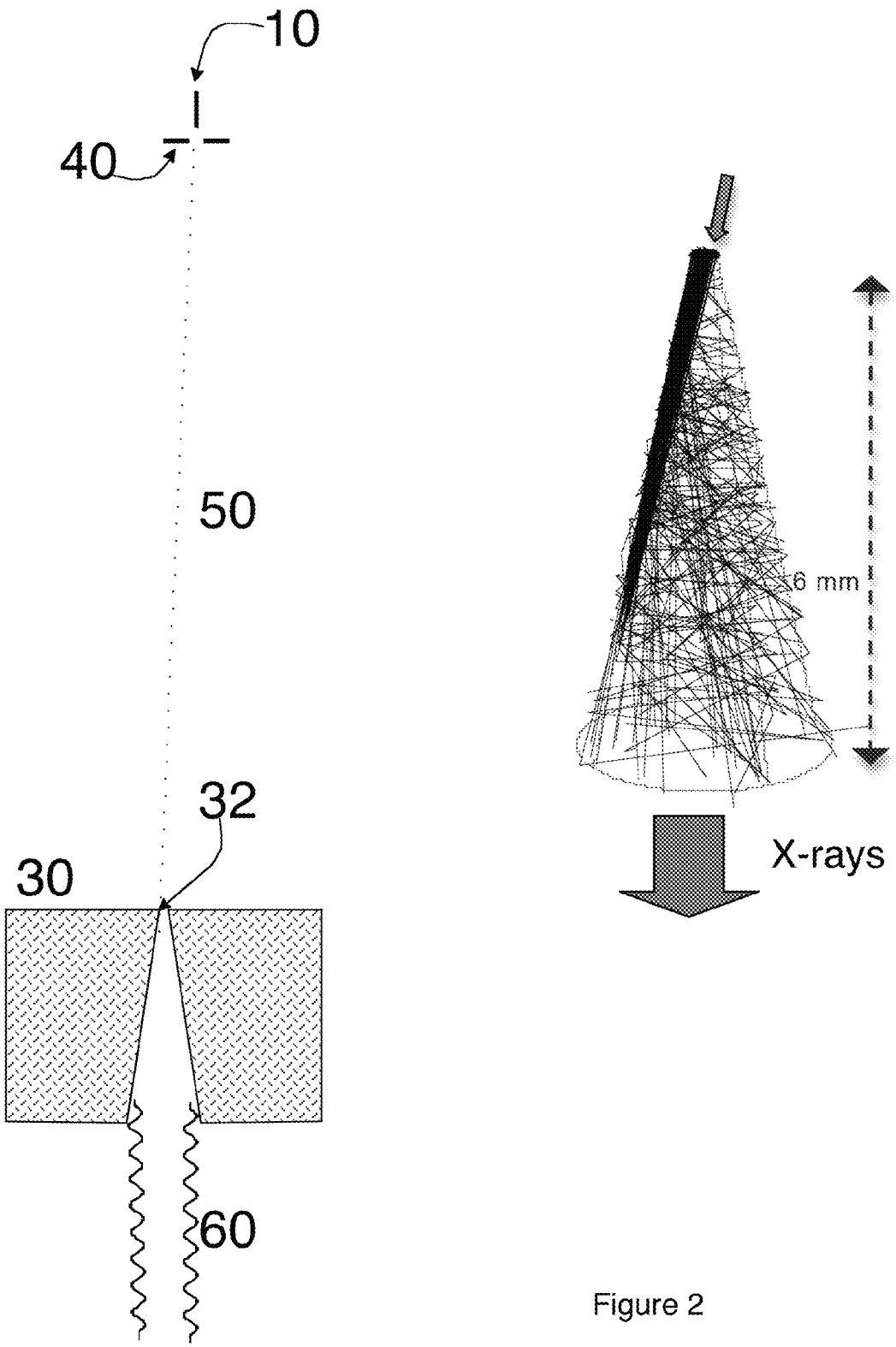
FIG. 2 shows another embodiment of an FFC x-ray source in which the channel has a conical shape with its narrow opening towards the cathode. The accompanying graphic shows the results of modeling run using the PENELOPE particle code to show where they have their primary impact on the channel, where they generate x-rays and where they scatter to generate more x-rays.

FIG. 2 shows a cone-shaped channel 32, in which the bottom of the channel is wider than the top of the channel. In this design, there are secondary electron impacts for much of the channel length, which yields a higher number of electron impacts, at the expense of a wider spot size. In this design, electron beam 50 is offset at a slight angle to the top surface of anode 30.

Figure 3:
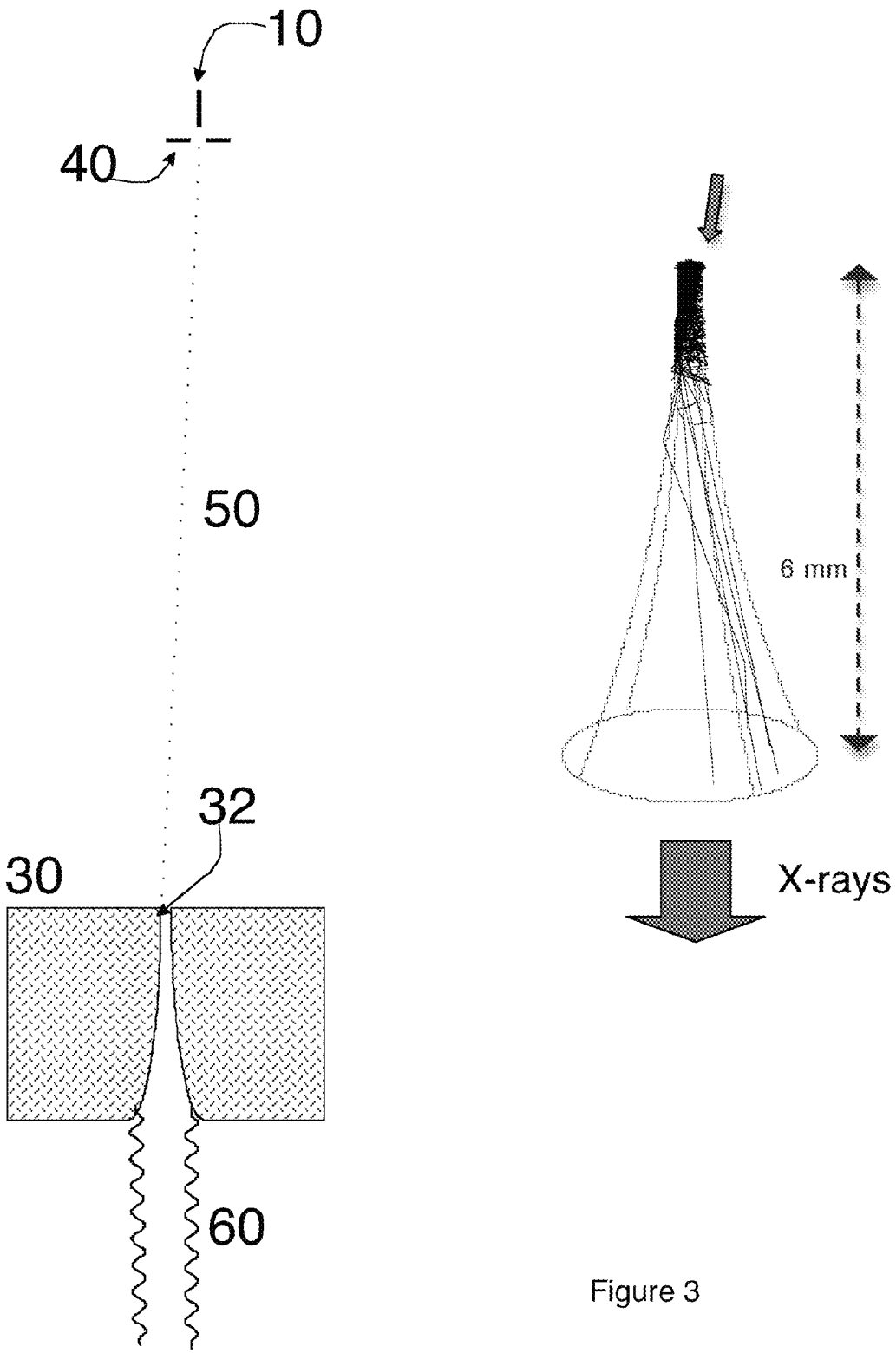
FIG. 3 shows another embodiment of an FFC x-ray source in which the channel has a first straight section and then a tapered section. The accompanying graphic shows the results of modeling run using the PENELOPE particle code to show where they have their primary impact on the channel, where they generate x-rays and where they scatter to generate more x-rays.

FIG. 3 shows a channel 32 which is straight at the top and then flares out towards the bottom. This design has somewhat fewer x-ray generating electron impacts, but a tighter spot size. Cathode 10 is slightly offset from the channel and e-beam 50 approaches channel 32 at a slight angle.

FIG. 4 shows an hourglass shaped channel 32 which has a wider upper acceptance region, then narrows and then flares out towards the bottom. The spot size is tight in this design, and the bottom flare can be chosen to provide a desired x-ray flux angle. The e-beam can be normal to the top of anode 30. An improvement on this design uses an annular e-beam 50 as shown in FIG. 5, to more uniformly impact the upper acceptance region of the channel.

FIG. 6 shows how e-beams 50 may be directed toward the channels at an angle from electron sources displaced from the normal line. In this figure, the electron source is a miniature Einsel lens gun source 16, using a cathode, such as a field emission cold cathode directing the emitted beam into the triple lens structure for a high degree of electron beam focus.

The channels in FFC sources may be fabricated a number of ways in a number of anode metals, such as W, Mo, Cu or Au. The metals may be chosen for the desired x-ray generation characteristics for a given anode voltage and ease of fabrication. In sealed sources, the metal may be chosen for ease of fabrication and thermal compatibility (such as with Kovar) with the rest of the vacuum package materials set, and another metal, chosen for its x-ray characteristics plated, evaporated, sputtered or otherwise deposited on the inner channel walls. For larger diameter channels, down to about 100 μm, diamond drilling and water jet can be used. For smaller channels the fabrication process choices include plunge EDM, laser milling, molding, chemical etch and focused ion beams (FIB). FIB tools are reliable for small feature sizes and can be programmed for complex shapes. They also have micro/nano etch capabilities. Another choice, for example with the hourglass-shaped channels, is to micro-mill halves of the shape on Cu or Kovar strips and then braze them together. A molding process is a further option. Arrays of silicon pillars in the desired shape can be formed with various processes then Cu plated, deposited or melted around them; the Si is then etched away.

There are also a number of cathode choices, including cold cathode field emitters, thermal filament emitters, dispenser cathodes or any other cathode which will fit into the source. Exemplary cold cathodes, particularly for cathode arrays, lateral thin film edge emitters, which may be made of various, materials, including carbon, layered films of different forms of carbon, carbon nanotubes or graphene, layered films of metal, layered films of metal and carbon, etc. Cathodes in the array may be stabilized by the incorporation of resistors for individual emitters of areas. The cathodes in the array may also be gated, so as to allow operation of the cathodes at lower voltages. Gates and focusing elements, such as electrostatic lenses, may be provided so as to direct the e-beams in an optimal direction. An exemplary cold cathode for an array is a disk pusher cathode, in which a large number of individual cold cathode tips face in towards a circular pusher electrode, which defines the spot size of the e-beam and which directs the electrons up off the cathode substrate and towards the anode. The pusher electrode may be biased so as to focus the beam and this focusing may be used in conjunction with other focusing elements. The beam shape is annular. Another cold cathode choice, for very tight annular beams, is to deposit large numbers of thin films of alternative insulating and conductive/emissive materials, such as diamond and Mo, around very thin wires, which are rotated in the deposition chamber. The wires are then into small sections to provide an annular metal-insulator-metal cold cathode which has proven to yield high, stable current levels. Another method for producing an annular beam, detailed below, is to use an internal accelerating grid with a retarding potential at the lower levels of the stack to widen the beam just before impact on the upper acceptance region of the anode channel.

A sealed, single channel FFC x-ray source is shown in FIG. 7. In addition to the source elements presented above and shown in FIGS. 1-5, a top cathode plate 11, side walls 20 and anode window plate 33 are provided to form the vacuum enclosure of the source, which needs to be evacuated to at least $10^{-5}$ Torr vacuum. Side walls 20 may be formed from a tube of ceramic, glass or other insulating material. Cathode top plate 11 can be metal, glass, ceramic or other material thermally compatible with the rest of the package. Anode window plate 33 is hermetically attached to anode metal 30. The anode window can be made very thin, since anode metal 30 will provide most of the mechanical support at this part of the package. Exemplary materials for the anode window include glass, Be, BeO and other materials which transmit a high degree of x-ray flux. X-ray filters, if needed, may be applied to the outside of the anode window. The anode window may also support zone plate optics or other x-ray focusing optical elements, which may be formed directly on the window. Whichever end of the source, cathode or anode, which is biased to high potential must be surrounded by an oil casing, potting compound of other electrical insulator. An oil casing with forced fluid flow may provide anode cooling, as may cooling lines surrounding the anode or cooling channels formed in the anode metal itself.

An FFC array source, shown in FIG. 8, has similar construction as the single channel FFC source, except the anode plate, anode window and cathode plate are wider to accommodate the arrays of electron sources and their corresponding anode channels. The plate and window elements may be made flat for a flat panel FFC source, or curved for a curved source. In FIG. 8, the cathodes 10 of the cathode array are disposed on cathode plate 11, which forms one major part of the vacuum enclosure of the source. In array sources, at least the top surface of the cathode plate must be insulating to electrically isolate the cathodes in the array. Anode plate 30 is made of or coated with the x-ray target material and disposed opposite and parallel to the cathode plate, and forms the second major structural part of the vacuum enclosure of the source. Insulating side walls 20 made of glass or ceramic form the other major parts of the vacuum enclosure of the source. In the case of very wide sources, internal spacing posts or bars may be provided for additional mechanical support against the outside atmospheric load. The anode has multiple flux channels which may be annular or of other shapes going through the anode plate. A thin sheet of glass or other x-ray window material is hermetically attached to the outside of the anode plate so as to maintain vacuum. The flux channels may be formed in an linear, x-y matrix or other formats. Individual cathodes in the array emit e-beams towards a corresponding flux channel in the anode plate. E-beam focusing elements inside the source may be used to direct the e-beams into the channel. The flux channels are shaped so that the e-beams will impact an upper acceptance region of the channel and so that a large portion of the electrons scattered from impact in the acceptance region will ricochet down the channel. X-ray flux is generated from these primary and ricochet (or secondary) impacts on the metals walls of the flux channels with the flux then exiting through the channels and out the window attached on the outside of the anode plate. In an FFC array source, the cathode side may be operated at high potential, since the anode window may not be able to stand off much voltage. As shown in FIG. 8, casing 21, which may be filled with oil, potting compound or other insulating material, surrounds the cathode plate and sides of the source (half of which is shown in FIG. 8).

The FFC arrays may be made in a number of formats and sizes. Cathode and channel pitch, their number, their arrangement and channel width and height may be chosen to suit the application.

FIG. 9 shows an exemplary cathode array layout wherein an x-y array of cold cathodes (10) is formed on cathode plate (11) and addressed in rows through cathode address lines (12). Cathode plate (11) can be made of any material but will have an insulating top surface so as to electrically isolate the cathodes in the array. Alternatively, the cathodes may be formed individually or on die which are then attached to cathode plate (11). Cathodes (10) can be any type of many cold cathodes known in the art, including metal tip arrays, semiconductor tip emitters, carbon nanotube (CNT) tip arrays, CNT rope emitters, surface conduction emitters, metal-insulator-metal (MIM) emitters, lateral edge emitters of various materials, or diamond flat cathodes. In the embodiment shown in the figure, extraction gates (40) are provided for each cathode and separately addressed through gate lead lines (41). This configuration allows the power of the source to be supplied through more robust cathode lead lines and gating to be performed at lower gate voltages and currents, allowing the use of inexpensive drive circuitry.

The cathode array can be operated in a variety of modes to generate x-ray pixels (xels) from the anode channels in whatever format suits the application. Xels may be address sequentially, maybe be multiplexed, may all be turned on at once, may be scanned as lines, or may be addressed in coded source patterns. For example, in an exemplary parallel beam imaging mode, a 77×77 array of xels will substantially reduce scatter in the imaging subject, allowing for the same image quality to be obtained at substantially lower doses. All the axels are operated simultaneously in this mode. With a large number of xels it is also possible to modulate the cathodes in the cathode array so as to provide spatial variations in the generated x-ray flux pattern. This may be used in dose reduction regimes which rely on lessening the dose in regions of less interest in the imaging application.

FIG. 10 shows an exemplary source with an internal beam accelerating structure. The potentials of the further electrodes in this structure may be varied so as to spread the beam somewhat as it heads towards the anode so as to increase the portion of the beam impacting the upper acceptance region of the channel.

FIG. 11 shows an exemplary stationary CT system made with FFC array sources of the present invention. In this case, the system is a field portable CT system for head and neck injury imaging. Three FFC array sources 100 are arranged in an arc above the patient and imaging is preformed by emitting flux to a flat panel x-ray detector 150 placed under the patient. Axial, longitudinal semi-helical scans may be performed with this system configuration. Other exemplary imaging systems which may be constructed in a similar way include pre-clinical small animal imaging systems and breast tomosynthesis or CT, in which cases the linear or few-row array sources may be formed in complete circles to emit x-ray flux to a corresponding circular x-ray detector offset from the source ring.

FIG. 12 depicts sequential firing of the xels across the source arc of a stationary tomosynthesis system in one dimension. FIG. 13 depicts multiple sequential firing of the xels so as to increase imaging speeds. All the xels labeled "1" are fired at the same time and produce images at different region of the detector. The "2" xels are then fired, and so on.

FIG. 13 depicts parallel collimated beam imaging enabled by the source. A large number of xels in an x-y array are fired simultaneously to produce very narrow beams, each corresponding to a region on the detector. This modality reduces scatter in the subject and allows lower doses to be used for the same image quality. Spreading the required flux power across the xel array allows cathode current density and the anode power load at each xel to be substantially reduced. 2D images may be generated this way. 3D tomographic images may be generated by moving this source, or by addressing shifting xel arrays across the panel or a tiled arc of panels.

FIG. 15 shows a typical imaging geometry for coded source imaging using an FFC array source. In general, the addressable FFC array source 206 emits photon flux 210 that is structured based on a specific spatial pattern or "code" 208, which passes (in part) through the subject 202. This scattered (transmitted) x-ray flux 212 strikes the detector 214, which captures the aggregate image 234. This detected image 238 is thus encoded. It is subsequently decoded in a decoding process 218 using a decoding pattern 220. The decoding pattern is matched to the code pattern (208), usually such that their cross-correlation resembles a spatial impulse function.

FFC array sources generating pencil beams or narrowly collimated beams of x-ray flux may also be advantageously used in PCI systems. Some PCI approaches can use polychromatic x-ray sources, for example, grating-based Talbot interferometry. In these approaches, the FFC source of FIG. 8 may be used. Other PCI approaches require coherent flux. FIG. 16 shows that the source of the present invention may be adapted for these other forms of PCI by the addition of a crystalline monochromator (array disposed so as to accept flux exiting the channels.

The present invention is well adapted to carry out the objects and attain the ends and advantages described as well as others inherent therein. While the present embodiments of the invention have been given for the purpose of disclosure numerous changes or alterations in the details of construction and steps of the method will be apparent to those skilled in the art and which are encompassed within the spirit and scope of the invention.

What is claimed is:

1. A forward flux channel x-ray source comprising:

a flat metal x-ray anode plate with at least one x-ray target channel running through said anode plate, wherein said at least one channel is configured to utilize most of the electrons of an incoming electron beam from both primary and secondary impacts of the electrons on the walls of said at least one channel; and at least one cathode disposed opposite to said anode plate and emitting at least one accelerated electron beam that impacts the upper portion of the wall of at least one of said at least one channel; wherein said electron beam generating x-rays from both the primary impacts of the electrons at said upper portion of said wall and the secondary impacts of scattered electrons on said walls of the at least one channel.

2. The source of claim 1 in which the upper portion of the inside channel wall is flared out so as to increase the number of primary electron impacts from an incoming electron beam emitted from the cathode opposite the channel.

3. The source of claim 1 in which the upper portion of the inside channel wall is angled so as to increase the number of primary electron impacts from an incoming electron beam emitted from the cathode opposite the channel.

4. The source of claim 1 in which the cathode opposite the channel in the anode plate is offset from normal to said anode channel and the electron beam enters said channel at an angle so as to increase the number of primary electron impacts from the incoming electron beam from said cathode.

5. The source of claim 1 in which a conical electron beam is emitted from the cathode above an annular channel so as to increase the number of primary electron impacts from the said annular electron beam.

6. The source of claim 1 in which an accelerating grid structure is provided between the cathode and the channel in the anode plate and is operable with retarding potential at the bottom portion of said accelerating grid so as to cause the electron beam emitted from said cathode to spread as it enters the channel.

7. A open source of claim 1, wherein the source in enclosed in an actively pumped vacuum chamber.

8. A sealed source of claim 1, in which one or more cathodes are disposed on a cathode plate, a flux exit window is hermetically attached to an anode plate having one or more channels formed therein, said cathode and anode plates being separated by insulating side walls and hermetically sealed to said side walls, and the interior of the hermetically sealed enclosure thus formed evacuated to at least $10^{-5}$ Torr.

9. An array source of claim 1 comprising:

an array of multiple, spaced apart, electrically isolated and individually addressable cathodes are disposed on a cathode plate;

an anode plate with multiple, spaced apart channels disposed opposite said cathode plate, the channels each disposed so as to receive an electron beam from a cathode on said cathode plate, and a flux exit window hermetically attached to the anode plate;

the cathodes in said array operable so as to emit individual electron beams to corresponding flux channels and generate x-rays on the inner walls of the channels in the anode plate, the flux then exiting the source; and insulating side walls, said insulating side walls, anode plate and cathode plate hermetically sealed together to form the vacuum enclosure of the source; and the interior of the enclosure thus formed evacuated to at least $10^{-5}$ Torr.

10. An x-ray imaging system using the source of claim 1.

* * * * *